US011404814B2

(12) United States Patent
Oka

(10) Patent No.: US 11,404,814 B2
(45) Date of Patent: Aug. 2, 2022

(54) STACKED CONNECTOR

(71) Applicant: SUMITOMO WIRING SYSTEMS, LTD., Mie (JP)

(72) Inventor: Kazumi Oka, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/098,644

(22) Filed: Nov. 16, 2020

(65) Prior Publication Data

US 2021/0167543 A1 Jun. 3, 2021

(30) Foreign Application Priority Data

Nov. 29, 2019 (JP) ..... JP2019-216127

(51) Int. Cl.
*H01R 13/506* (2006.01)
*H01R 13/424* (2006.01)

(52) U.S. Cl.
CPC ..... *H01R 13/506* (2013.01); *H01R 13/424* (2013.01)

(58) Field of Classification Search
None
See application file for complete search history.

(56) References Cited

U.S. PATENT DOCUMENTS

| | | | | |
|---|---|---|---|---|
| 7,354,318 | B2 | 4/2008 | Murakami et al. | |
| 7,481,682 | B2 | 1/2009 | Murakami et al. | |
| 7,594,830 | B2 | 9/2009 | Murakami et al. | |
| 8,353,732 | B2 | 1/2013 | Ito | |
| 2019/0267746 | A1* | 8/2019 | Chikusa | H01R 13/422 |

FOREIGN PATENT DOCUMENTS

| | | | |
|---|---|---|---|
| JP | 2019-087366 | A | 6/2019 |

* cited by examiner

*Primary Examiner* — Oscar C Jimenez
(74) *Attorney, Agent, or Firm* — Venjuris, P.C.

(57) ABSTRACT

A connector is provided with a first housing 10A and a second housing 10B to be arranged to cover a first facing surface 11A of the first housing 10A. The first housing 10A includes bearing portions 21 provided on a front end side and lock receiving portions 22 provided behind the bearing portions 21. The second housing 10B includes shaft portions 42 provided on a front end side and to be rotatably supported in the bearing portions 21, and partial locking portions 43 provided behind the shaft portions 42. The partial locking portions 43 lock the lock receiving portions 22 to temporarily hold the second housing 10B in a state inclined rearward from the shaft portions 42 away from the first facing surface 11A.

5 Claims, 10 Drawing Sheets

STACKED CONNECTOR

CROSS-REFERENCE TO RELATED APPLICATIONS

This application is based on and claims priority from Japanese Patent Application No. 2019-216127, filed on Nov. 29, 2019, with the Japan Patent Office, the disclosure of which is incorporated herein in their entireties by reference.

TECHNICAL FIELD

The present disclosure relates to a connector.

BACKGROUND

In a stacked connector disclosed in Japanese Patent Laid-Open Publication No. 2019-087366, a locking projection provided on the front end of an upper housing is loosely locked into a locking recess provided in the front end of a lower housing. The upper housing is assembled with the lower housing by being rotated with the locking recess of the lower housing as a fulcrum. The respective housings of such a connector are separately managed until terminals are inserted into the housings to obtain a finished product. Thus, parts management is cumbersome. Accordingly, a configuration for facilitating parts management by setting a first housing and a second housing in a partially locked state as in a connector of Japanese Patent Laid-Open Publication No. 2010-170723 is known. Further, a connector of Japanese Patent Laid-Open Publication No. 2004-335305 is similarly configured such that a female housing and a male housing are set in a partially locked state.

SUMMARY

In the case of Japanese Patent Laid-Open Publication No. 2010-170723, it is difficult to stop the second housing at a partial locking position with respect to the first housing and the second housing easily drops toward a full locking position. A partial locking structure of Japanese Patent Laid-Open Publication No. 2010-170723 is formed in each of front and rear sides of the connector. Thus, the partial locking structure has to be formed at each of the front and rear sides of the connector while attention is paid such that the second housing does not drop toward the full locking position. Therefore, it has been difficult to maintain the partially locked state.

The present disclosure was completed on the basis of the above situation and aims to provide a connector capable of easily maintaining a partially locked state.

The present disclosure is directed to a connector with a first housing, and a second housing to be arranged to cover one surface of the first housing, wherein the first housing includes a bearing portion provided on a front end side and a partial lock receiving portion provided behind the bearing portion, the second housing includes a shaft portion provided on a front end side and to be rotatably supported in the bearing portion and a partial locking portion provided behind the shaft portion, and the partial locking portion locks the partial lock receiving portion to temporarily hold the second housing in a state inclined rearward from the shaft portion away from the one surface.

According to the present disclosure, it is possible to provide a connector capable of easily maintaining a partially locked state.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
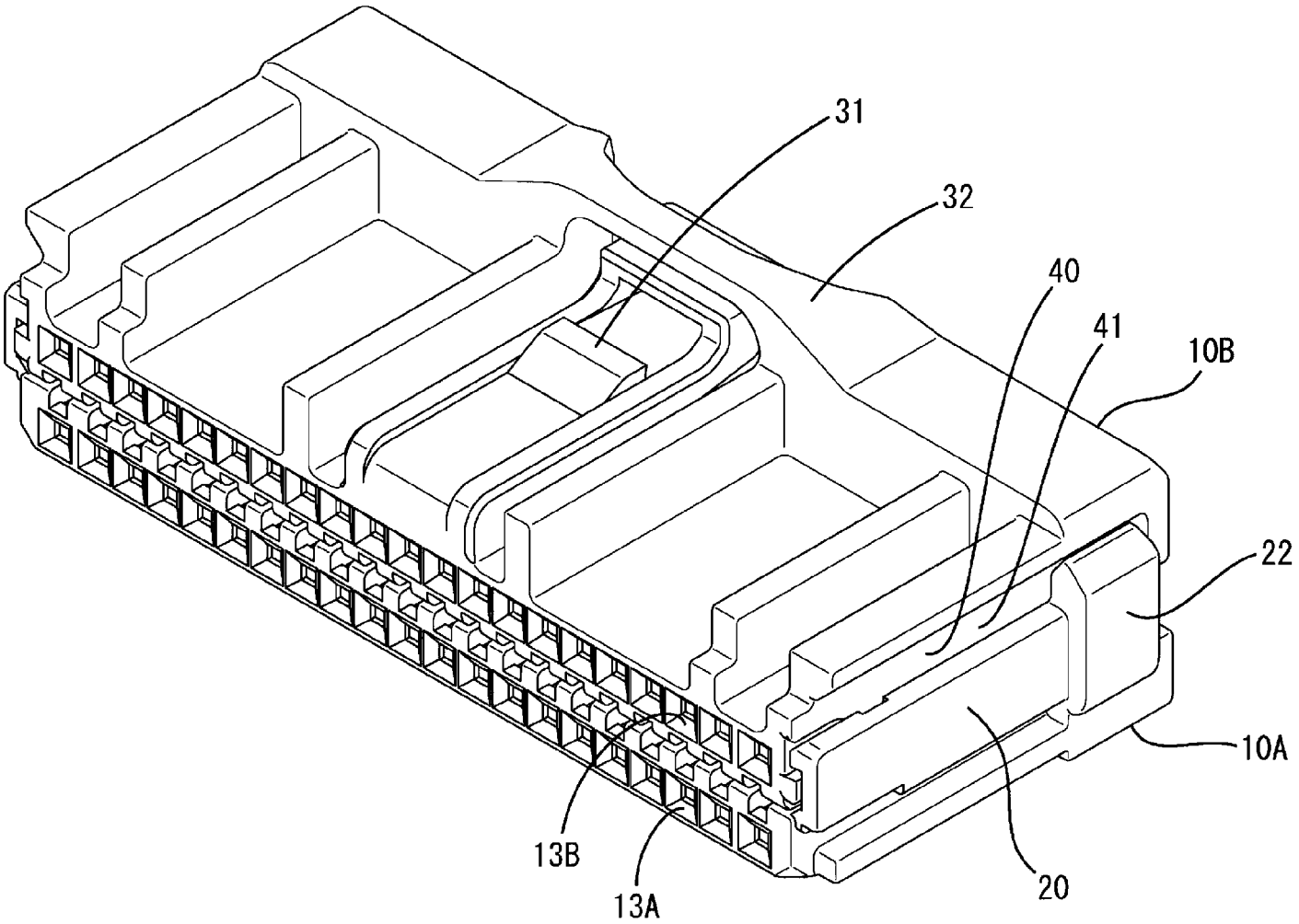
FIG. 1 is a perspective view of a connector of one embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The connector of the present disclosure is provided with a first housing, and a second housing to be arranged to cover one surface of the first housing, wherein the first housing includes a bearing portion provided on a front end side and a partial lock receiving portion provided behind the bearing portion, the second housing includes a shaft portion provided on a front end side and to be rotatably supported in the bearing portion and a partial locking portion provided behind the shaft portion, and the partial locking portion locks the partial lock receiving portion to temporarily hold the second housing in a state inclined rearward from the shaft portion away from the one surface.

If the second housing is temporarily held, the second housing is separated from the one surface of the first housing. Thus, the deflection of the locking lance is allowed and a terminal can be mounted into the first housing, for example, if the locking lance is exposed on the one surface of the first housing. Further, if the locking lance is exposed on the surface facing one surface of the second housing, a terminal can be mounted also into the second housing by temporarily holding the second housing. By releasing a temporarily held state of the second housing thereafter, the second housing can reach a state where the second housing is arranged to cover the one surface of the first housing (hereinafter, referred to as a fully locked state). A partial locking structure by the partial lock receiving portion and the partial locking portion is formed on rear end sides of the first and second housings, but not formed on front end sides of the first and second housings. On the front end sides of the first and second housings, a supporting structure by the shaft portion and the bearing portion is formed. Until the second housing reaches the fully locked state from the temporarily held state, the shaft portion rotates with respect to the bearing portion, thereby being maintained in a state supported in the bearing portion. Thus, in temporarily holding the second housing on the first housing, it is possible to eliminate a concern that the front end side of the second housing drops toward the first housing to reach the fully locked state and to easily maintain a partially locked state.

(2) Preferably, the partial locking portion and the partial lock receiving portion are arranged to contact along a front-rear direction.

According to this configuration, the temporarily held state in which the second housing is inclined can be satisfactorily maintained.

(3) Preferably, the partial lock receiving portion includes a front stop portion configured to contact a front end of the partial locking portion.

According to this configuration, the second housing in an inclined state can be prevented from being displaced forward with respect to the first housing.

(4) Preferably, the first housing includes a pair of side walls rising from the one surface side, the second housing includes a pair of side surfaces facing inner surfaces of the pair of side walls, the pair of side surfaces include the shaft portions having a convex shape, and the pair of side walls include, on the inner surface facing each other, the bearing portions having a concave shape and guiding surfaces inclined away from each other from the side of the bearing portions toward tips of the side walls in a rising dire.

According to this configuration, in the connector, the shaft portions can be slid along the guiding surfaces to deflect and deform the side walls in the process of bringing the second housing closer to the one surface of the first housing. By releasing a deflected state of the side walls and fitting the shaft portions into the bearing portions, the second housing can be locked to the front end side of the first housing. In this way, the second housing can be assembled from a position separated from the one surface of the first housing.

Details of Embodiment of Present Disclosure

Embodiment

Figure 4:
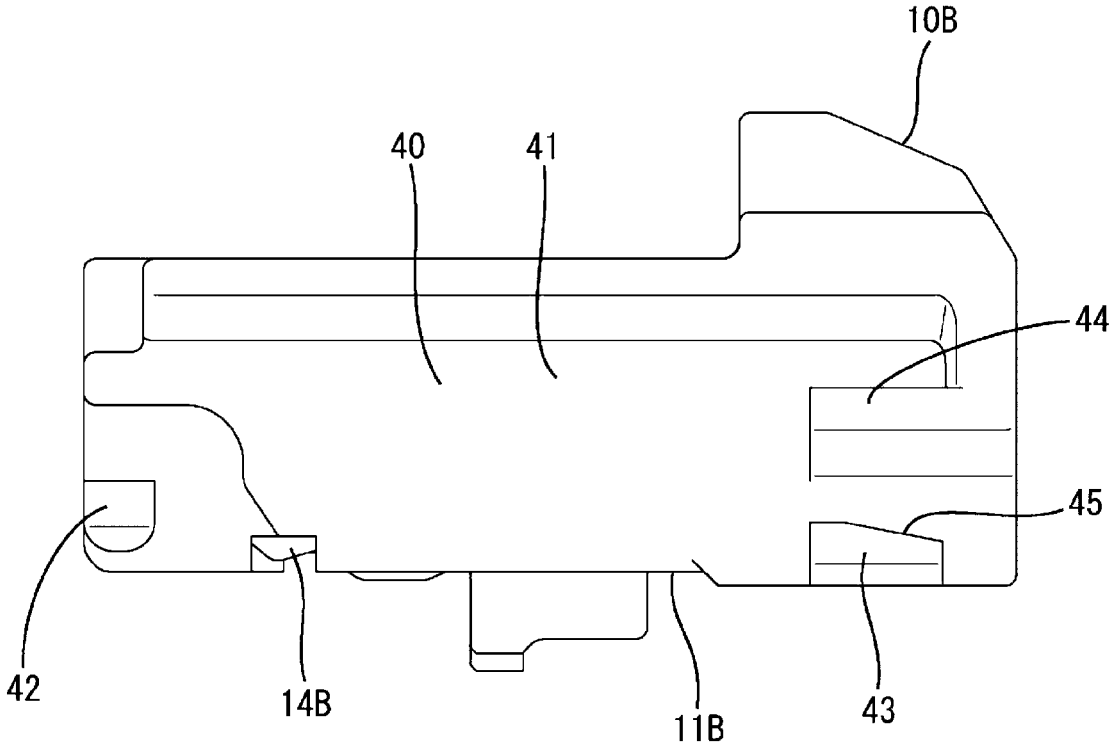
FIG. 4 is a side view of a second housing.
Figure 5:
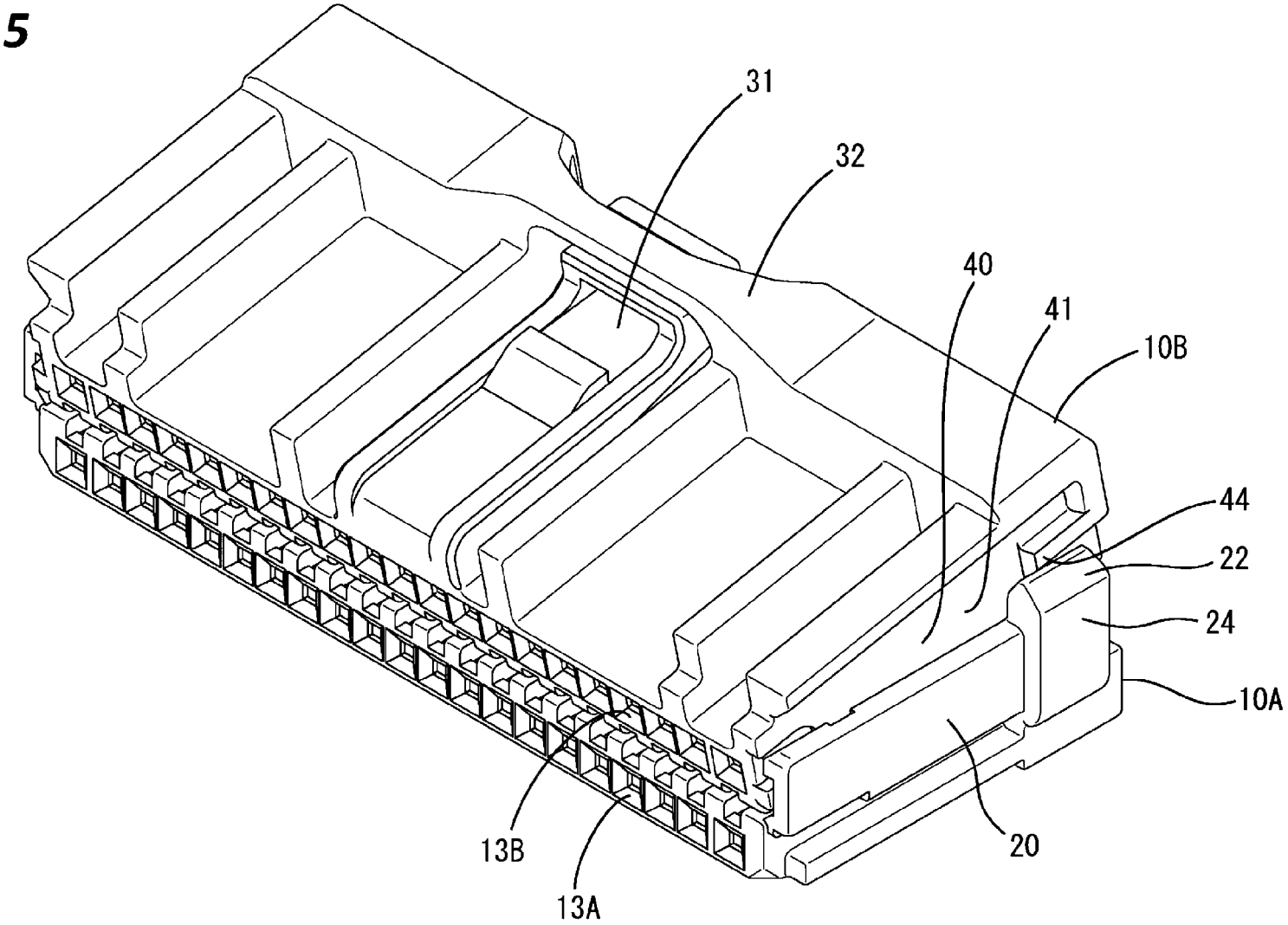
FIG. 5 is a perspective view of the connector in a partially locked state viewed from a front-upper side.
Figure 6:
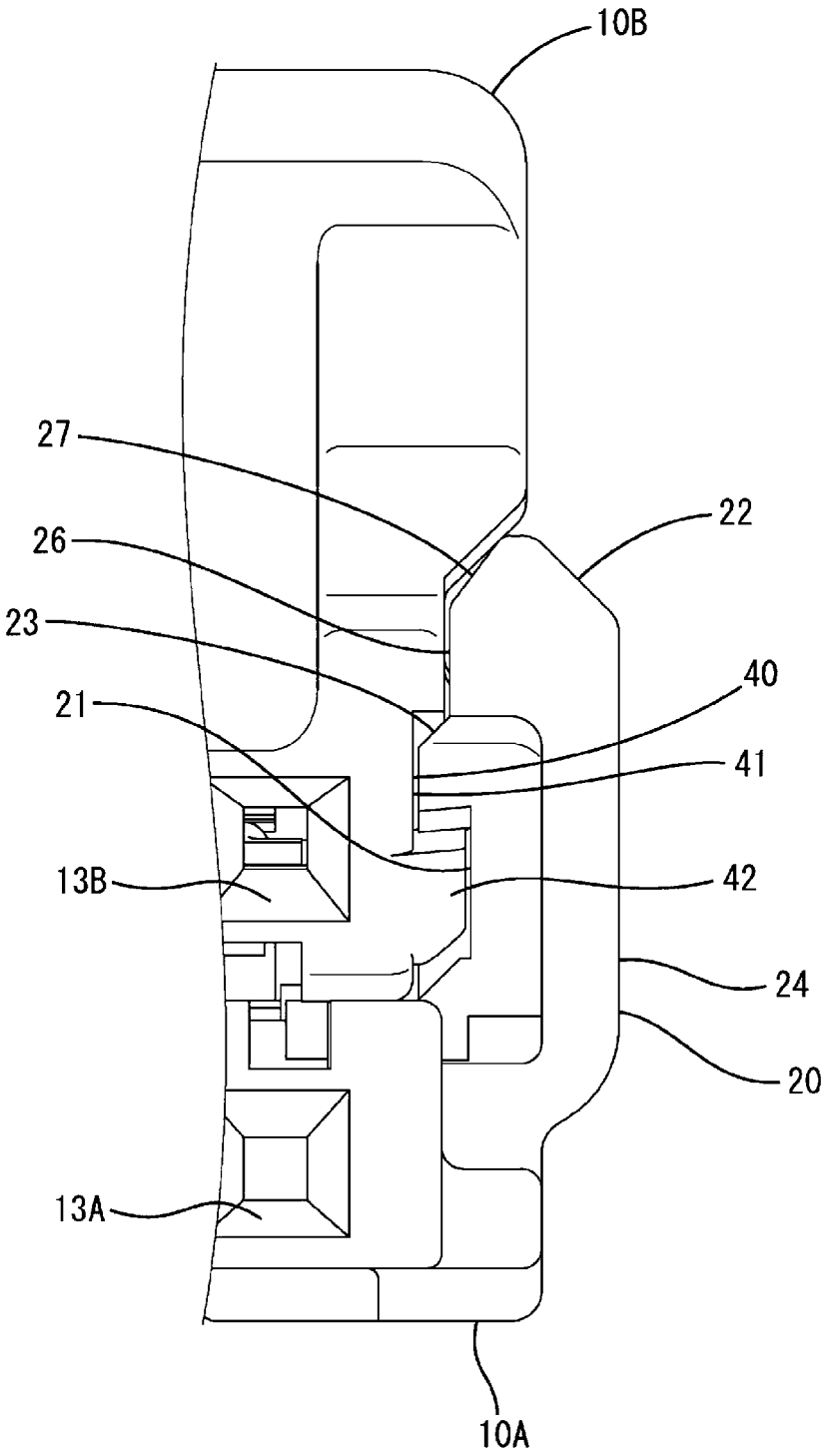
FIG. 6 is a partially enlarged view of the connector in the partially locked state viewed from front.
Figure 7:
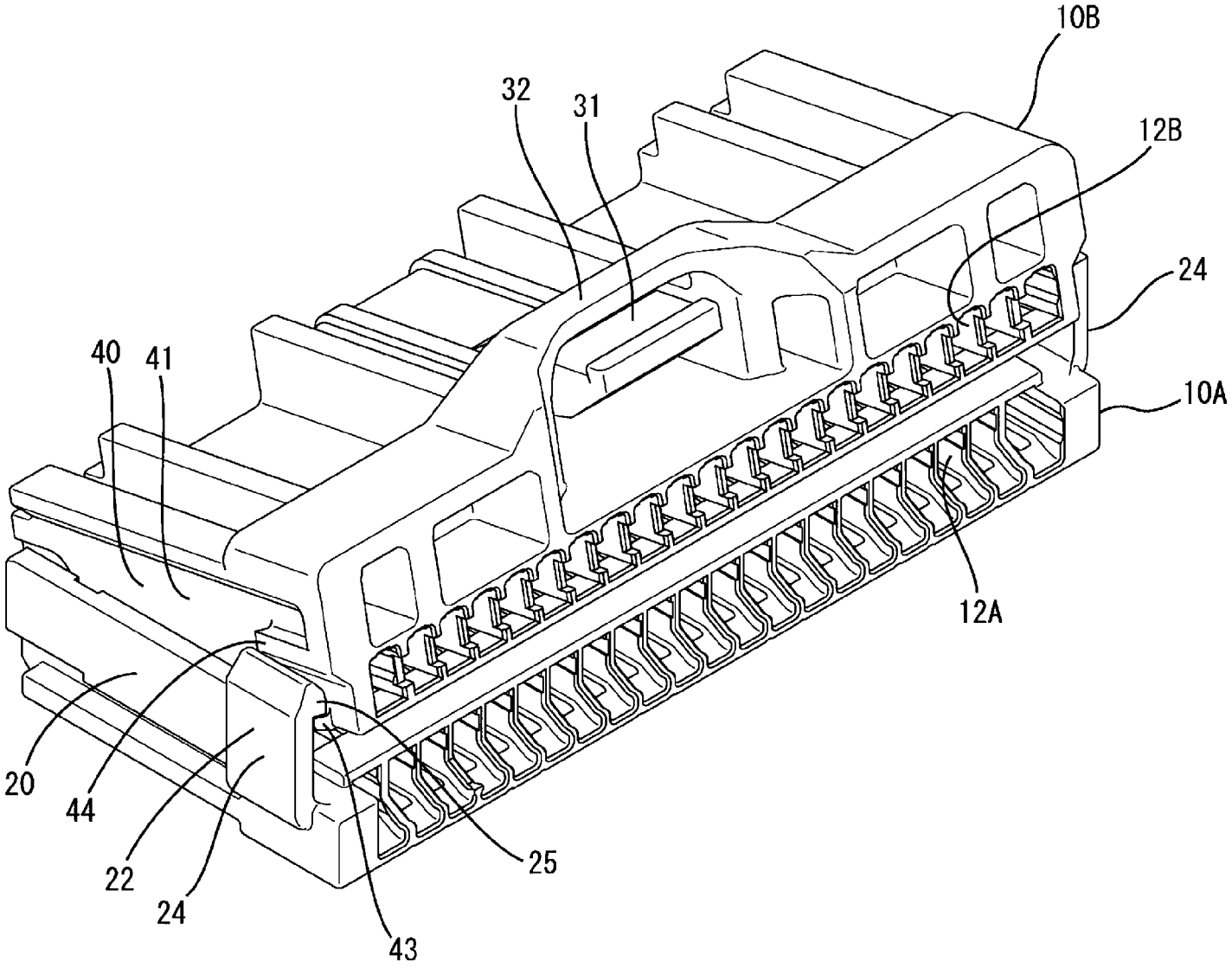
FIG. 7 is a perspective view of the connector in the partially locked state viewed from a rear-upper side.
Figure 8:
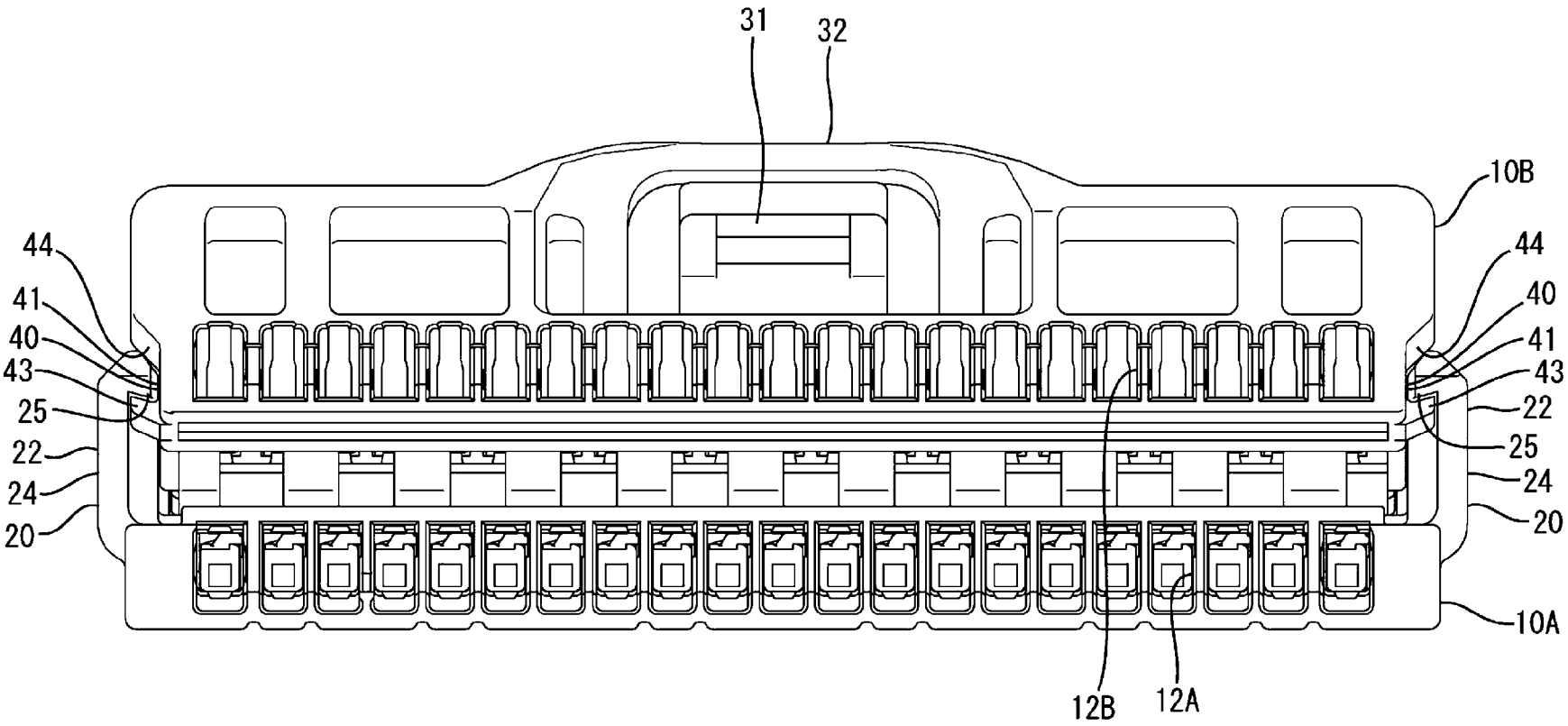
FIG. 8 is a back view of the connector in the partially locked state.

One specific embodiment of the connector of the present disclosure is described with reference to FIGS. 1 to 10. In this embodiment, left and right sides in FIGS. 1 to 5, 7, 9 and 10 are referred to as front and rear sides concerning a front-rear direction. Upper and lower sides shown in each figure are directly defined as upper and lower sides concerning a vertical direction. Left and right sides shown in FIGS. 6 and 8 are directly defined as left and right sides concerning a lateral direction.

Figure 2:
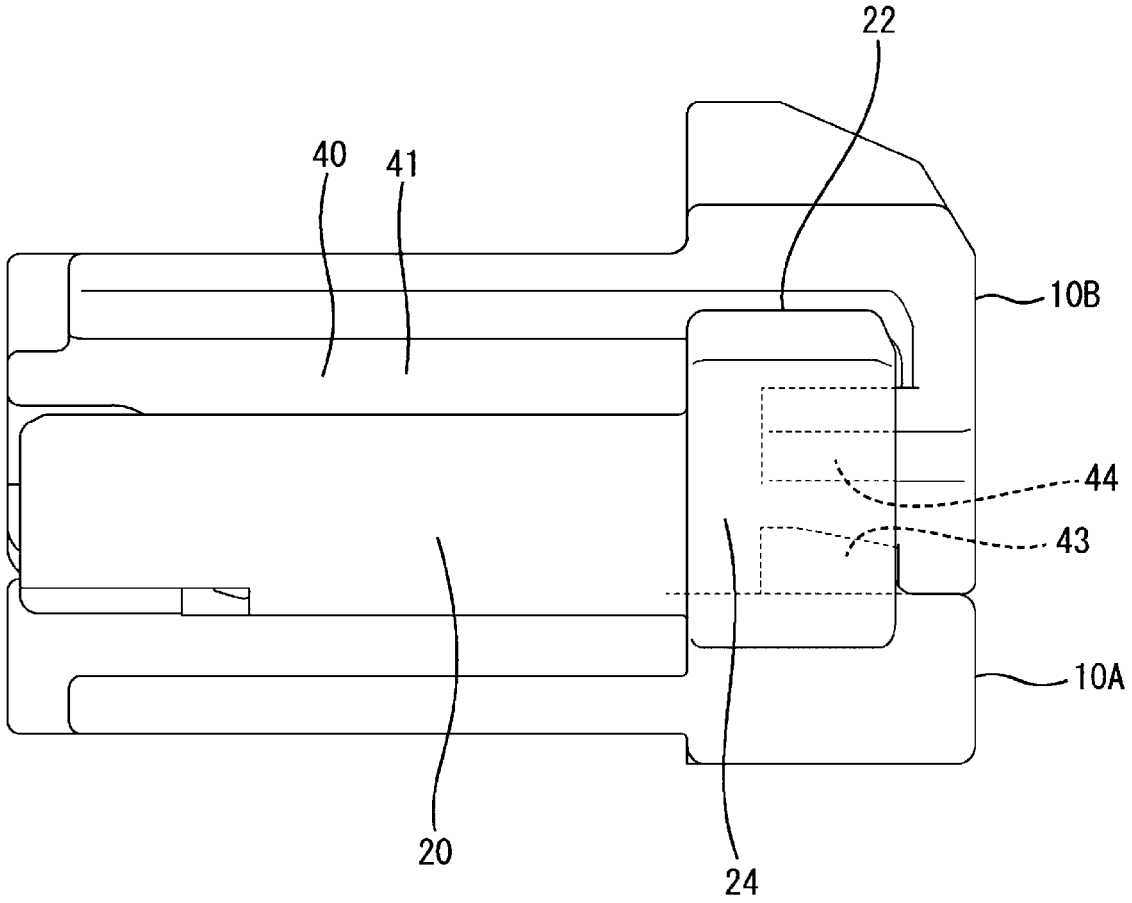
FIG. 2 is a side view of the connector.

The connector of this embodiment includes a first housing 10A and a second housing 10B to be stacked on each other as shown in FIGS. 1 and 2, a plurality of first terminal fittings (not shown) and a plurality of second terminal fittings (not shown) to be respectively accommodated into the first housing 10A and the second housing 10B.

Figure 3:
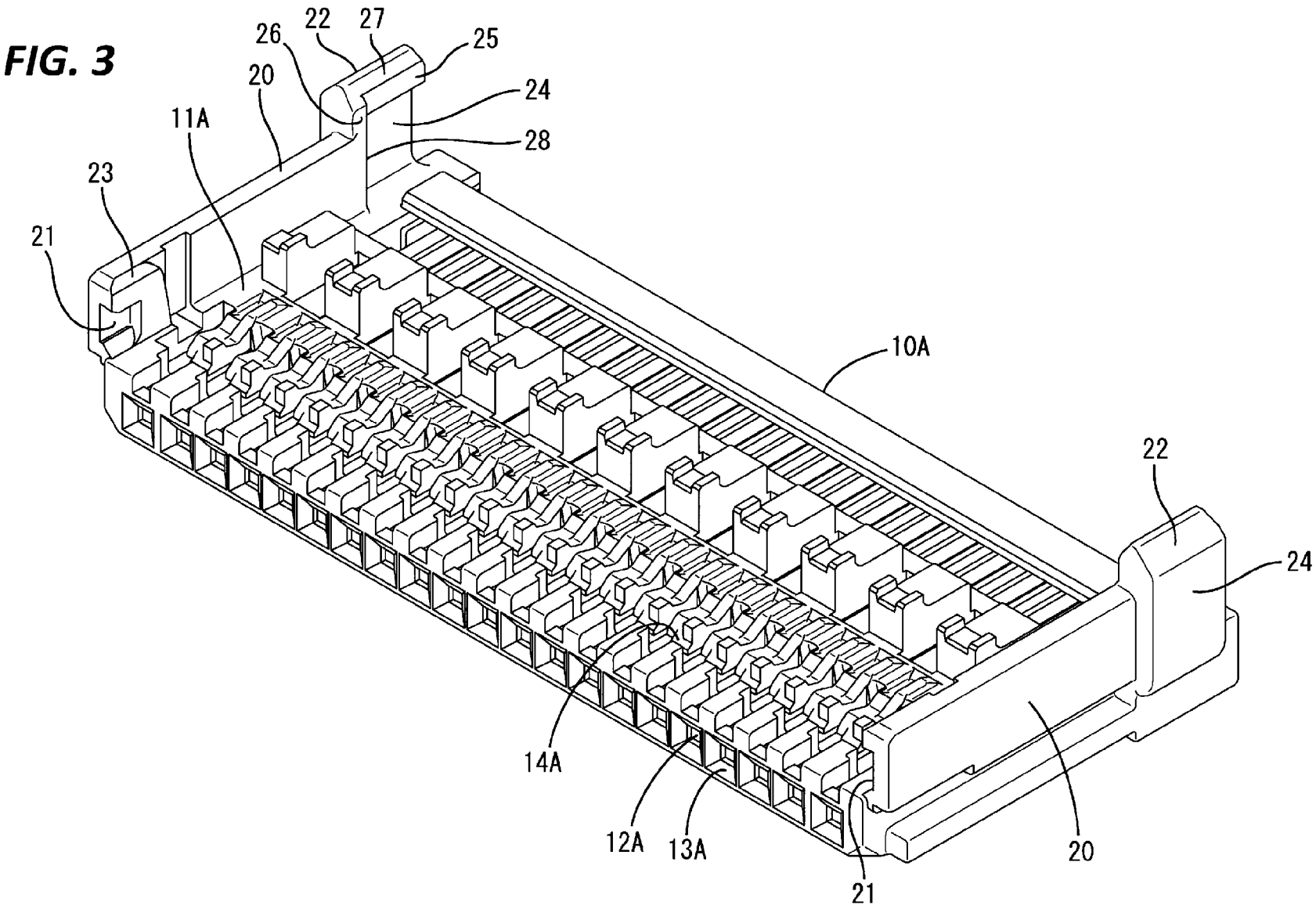
FIG. 3 is a perspective view of a first housing.

The first housing 10A is a lower housing located on a lower side and, as shown in FIG. 3, has a flat shape long in the lateral direction and has a first facing surface 11A (one surface) facing the second housing 10B as a stacking partner on an upper surface. The first housing 10A includes a plurality of first cavities 12A into which the first terminal fittings are insertable. The respective first cavities 12A are arranged side by side in one row in the lateral direction.

The first housing 10A includes a plurality of first insertion openings 13A communicating with the respective first cavities 12A in a front wall part. When the connector is connected to an unillustrated mating connector, tabs of unillustrated mating first terminal fittings mounted in the mating connector enter the corresponding first cavities 12A through the respective first insertion openings 13A.

The first housing 10A includes first locking lances 14A cantilevered forward from central parts in the front-rear direction of the first cavities 12A at positions corresponding to the respective first cavities 12A. Each first locking lance 14A is entirely exposed on the first facing surface 11A. The first locking lance 14A is deflectable to project toward the first facing surface 11A (side toward which the second housing 10B is stacked). The first locking lance 14A resiliently locks the first terminal fitting inserted into the first cavity 12A and retains the first terminal fitting.

The first housing 10A includes a pair of side walls 20 rising from both left and right end sides of the first facing surface 11A. The side walls 20 are formed to be long in the front-rear direction from a front end side to a rear end side of the first housing 10A. The side wall 20 is deflectable with a base end part on the side of the first facing surface 11A as a fulcrum. The side wall 20 includes a bearing portion 21 and a lock receiving portion (partial lock receiving portion) 22. The bearing portions 21 are provided on inner surfaces (surfaces of the pair of side walls 20 facing each other) on the front end sides of the side walls 20. The bearing portion 21 is formed by recessing the inner surface of the side wall 20, and open on front and inner sides. The pair of side walls 20 are provided with guiding surfaces 23 inclined away from each other toward upper ends. The guiding surfaces 23 are arranged on upper parts of the bearing portions 21.

The side wall 20 includes a part projecting upward and laterally in a rear end part. A step 28 along the vertical direction is provided on the inner surface of the rear end part of the side wall 20. Out of both front and rear sides of the inner surface of the side wall 20 across the step 28, a region on the rear side is recessed further outward than a region on the front side. The lock receiving portion 22 is provided behind the bearing portion 21 and on the inner surface of the rear end part of the side wall 20. The lock receiving portion 22 locks a partial locking portion 43 of the second housing 10B to be described later. The lock receiving portion 22 includes a wall portion 24, a projecting portion 25 and a front stop portion 26 on the inner surface of the side wall 20. The wall portion 24 is a wall surface located behind the step 28 in the rear end part of the side wall 20. The wall portion 24 is arranged along the vertical and front-rear directions. The projecting portion 25 is in the form of a rib extending in the front-rear direction in an upper end part of the side wall 20 and defines the upper end of the wall portion 24. The upper surface of the projecting portion 25 is formed into a guiding surface 27 inclined outward toward the upper end of the side wall 20. The front stop portion 26 can contact the front end of the partial locking portion 43 to be described later in a partially locked state of the connector. The front stop portion 26 is located in front of the step 28 in the rear end part of the side wall 20 and arranged inward of the wall portion 24 and the projecting portion 25 via the step 28. The front stop portion 26 is in the form of a rib extending in the vertical direction.

The second housing 10B is an upper housing located on an upper side and, as shown in FIG. 1, has a flat shape long in the lateral direction and has a second facing surface 11B (see FIG. 4) facing the first housing 10A as a stacking partner on a lower surface. As shown in FIG. 5, the second housing 10B includes a cantilevered and deflectable lock arm 31 in a laterally central part of an upper surface. The second housing 10B includes a covering wall 32 extending over to cover a rear end part of the lock arm 31. The covering wall 32 restricts the action of an unnecessary releasing force on the lock arm 31.

The second housing 10B includes second cavities 12B (see FIG. 7) formed similarly to the first cavities 12A, second insertion openings 13B (see FIG. 1) formed similarly to the first insertion openings 13A and second locking lances 14B (see FIG. 4) formed similarly to the first locking lances 14A. The second locking lances 14B are exposed on the second facing surface 11B. If the first housing 10A and the second housing 10B are stacked and fully locked, the first locking lances 14A and the second locking lances 14B are arranged back-to-back.

As shown in FIG. 8, the second housing 10B has a pair of side surfaces 41 facing the inner surfaces of the pair of side walls 20 on both left and right ends. As shown in FIG. 4, the side surface 41 includes a shaft portion 42, the partial locking portion 43 and a full locking portion 44. The shaft portion 42 is provided on a front end side of the side surface 41. The shaft portion 42 has a convex shape projecting outward. The shaft portion 42 is formed into a rectangular shape in a side view except in a lower part. The lower part of the shaft portion 42 is curved to be convex downward in a side view. As shown in FIG. 6, the lower part of the shaft portion 42 is inclined upward toward an outer side in a front view. The shaft portion 42 is inserted into the bearing portion 21 and rotatably supported in the bearing portion 21. The lower part of the shaft portion 42 slides on the inner surface of the bearing portion 21 during rotation.

The partial locking portion 43 is provided behind the shaft portion 42 on the side surface 41. The partial locking portion 43 locks the lock receiving portion 22, whereby the connector is partially locked. The partial locking portion 43 projects outward from the side surface 41. The partial locking portion 43 is long in the front-rear direction. The partial locking portion 43 has an inclined surface 45 inclined downward toward a rear side on a rear end side of an upper surface. The lower surface of the partial locking portion 43 is arranged along the front-rear direction in a side view. The lower surface of the partial locking portion 43 is inclined upward toward an outer side in a front view.

The full locking portion 44 is provided above the partial locking portion 43 on the side surface 41. The full locking portion 44 locks the lock receiving portion 22, whereby the connector is fully locked. The full locking portion 44 projects outward from the side surface 41. The full locking portion 44 is L-shaped in a side view. The upper and lower surfaces of the full locking portion 44 are arranged along the front-rear direction in a side view. The lower surface of the full locking portion 44 is inclined upward toward an outer side in a front view.

Next, an assembly method and functions of the connector of this embodiment are described.

Figure 9:
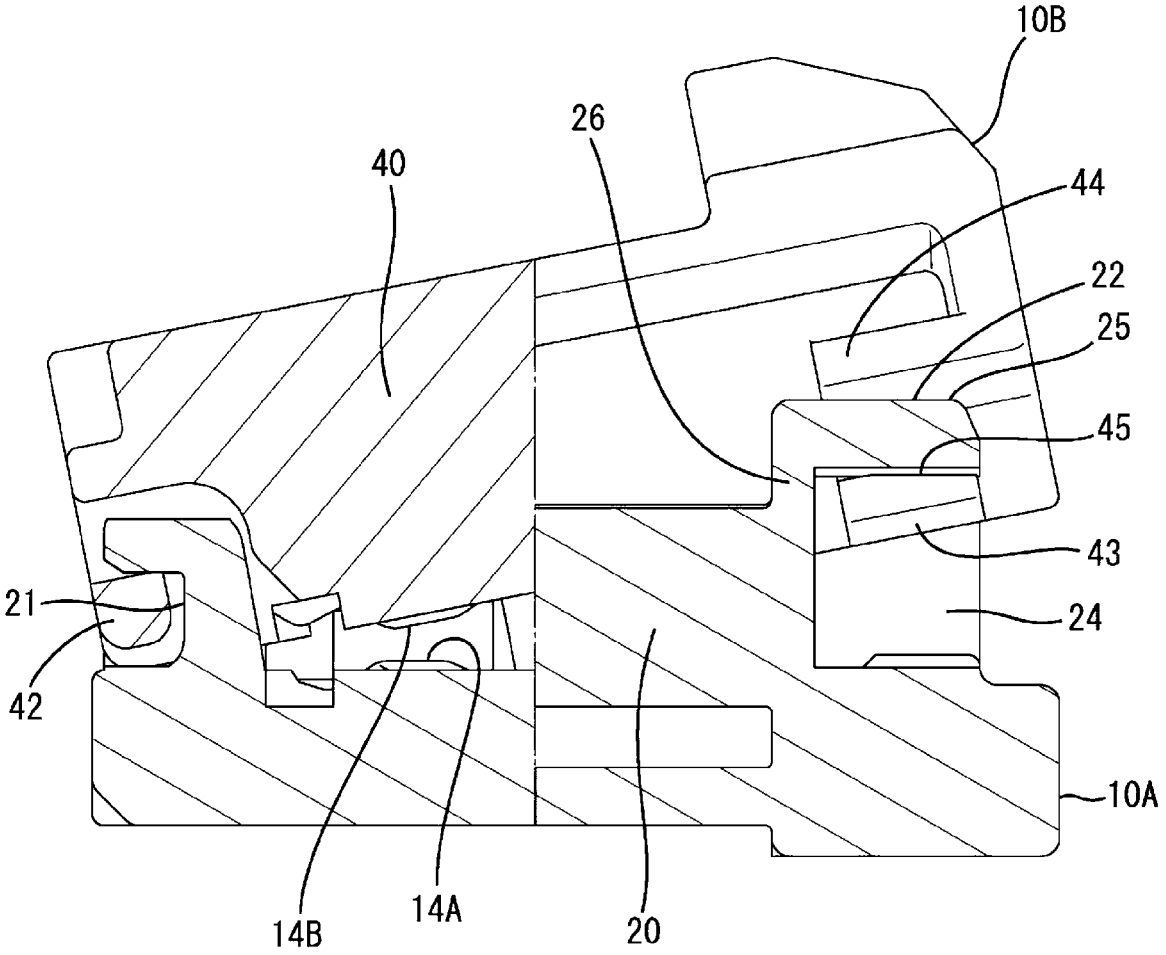
FIG. 9 is a side view in section of the connector in the partially locked state.

First, the first terminal fittings connected to wires are inserted and accommodated into the first cavities 12A of the first housing 10A from behind. Similarly, the second terminal fittings connected to wires are inserted and accommodated into the second cavities 12B of the second housing 10B from behind. Subsequently, the second housing 10B is set in a posture inclined downward toward the front and brought closer to the first housing 10A from above. In the process of bringing the second housing 10B closer to the first facing surface 11A of the first housing 10A, the shaft portions 42 can be slid along the guiding surfaces 23 to deflect and deform the side walls 20. By releasing a deflected state of the side walls 20 and fitting the shaft portions 42 into the bearing portions 21 as shown in FIGS. 5, 6 and 9, the second housing 10B can be locked to a front end side of the first housing 10A. The shaft portions 42 are rotatably supported in the bearing portions 21. Of course, the shaft portions 42 may be inserted into the bearing portions 21 through front openings of the side walls 20 from front with the second housing 10B tilted such that the shaft portions 42 are located on a lower side, and a front end side of the second housing 10B may be locked to the front end side of the first housing 10A.

Subsequently, the second housing 10B is rotated with the shaft portions 42 as fulcrums to bring the rear end of the second housing 10B closer to the rear end of the first housing 10A. In a rotation process, the partial locking portions 43 can be slid along the guiding surfaces 27 to deflect and deform the side walls 20. By releasing the deflected state of the side walls 20, causing the partial locking portions 43 to face the wall portions 24 and fitting the projecting portions 25 of the lock receiving portions 22 between the partial locking portions 43 and the full locking portions 44 as shown in FIGS. 7 to 9, the partial locking portions 43 lock the lock receiving portions 22. As shown in FIG. 9, the partial locking portions 43 and the lock receiving portions 22 are arranged to contact along the front-rear direction. Specifically, the inclined surfaces 45 of the partial locking portions 43 and the lower surfaces of the lock receiving portions 22 come into contact along the front-rear direction. In this way, a displacement of the second housing 10B in a direction to escape upward from the first housing 10 is restricted. Further, a displacement of the second housing 10B toward the first housing 10A to reach a fully locked state is restricted. The second housing 10B is arranged in a temporarily held state to be inclined rearward from the shaft portions 42 away from the first facing surface 11A by the partial locking portions 43 locking the lock receiving portions 22. At this time, the front stop portions 26 of the lock receiving portions 22 are located in front of the partial locking portions 43. Thus, the second housing 10B in an inclined state can be prevented from being displaced forward with respect to the first housing 10A.

Note that, in this connector, the second terminal fittings connected to the wires can be inserted and accommodated into the respective second cavities 12B of the second housing 10B from behind in the partially locked state. At this time, in the connector, the rear end side of the second housing 10B is lifted from the first facing surface 11A of the first housing 10A in the partially locked state. Thus, the deflection of the second locking lances 14B is allowed and the second terminal fittings can be inserted into and withdrawn from the second cavities 12B. Note that it is also possible to insert and withdraw the first terminal fittings into and from the first cavities 12A with the second housing 10B temporarily held on the first housing 10A.

Figure 10:
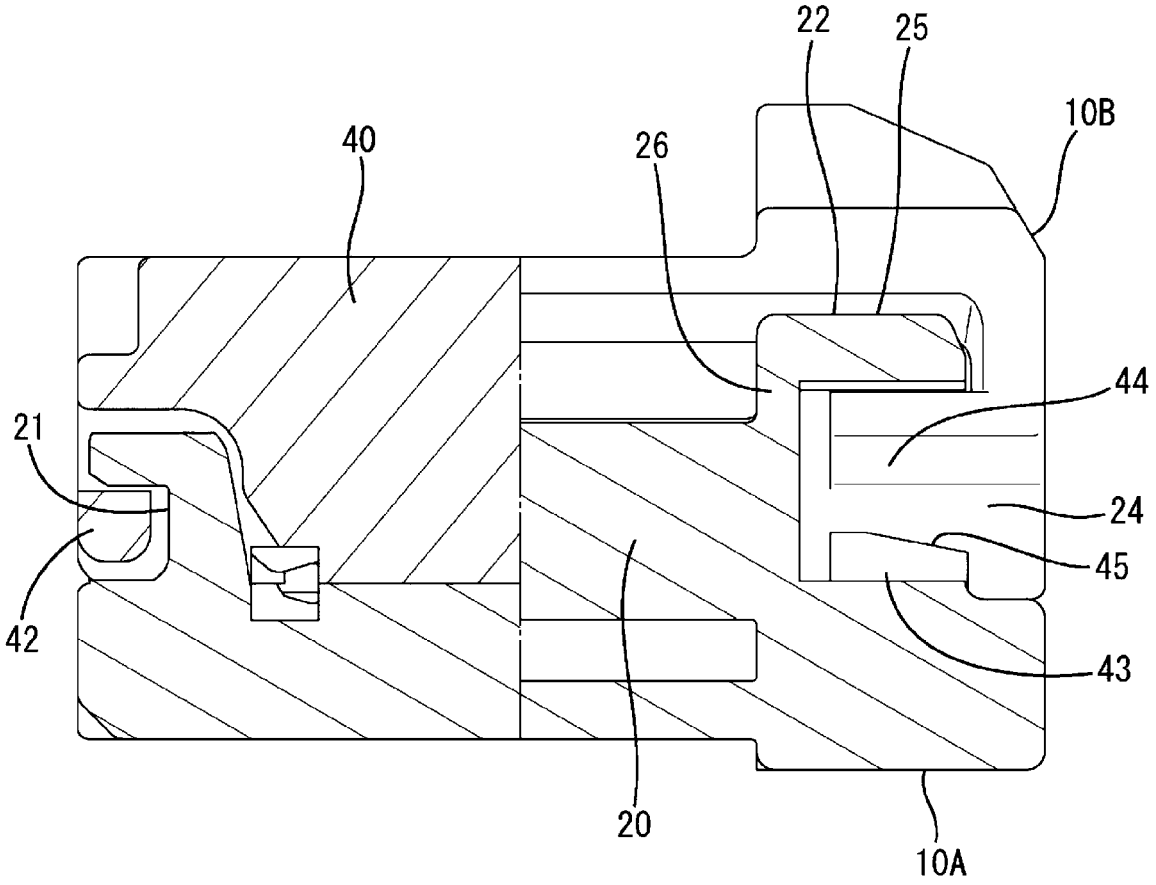
FIG. 10 is a side view in section of the connector in a fully locked state.

Subsequently, the second housing 10B is further rotated with the shaft portions 42 as fulcrums to bring the rear end of the second housing 10B closer to the rear end of the first housing 10A. In a rotation process, the full locking portions 44 can be slid along the guiding surfaces 27 to deflect and deform the side walls 20. The deflected state of the side walls 20 is released, and the full locking portions 44 are arranged to face the wall portions 24 and contact the lower surfaces of the projecting portions 25 of the lock receiving portions 22 as shown in FIG. 10. In this way, the full locking portions 44 lock the lock receiving portions 22 and the second housing 10B is arranged in the fully locked state to be stacked on the first housing 10A. At this time, the first facing surface 11A and the second facing surface 11B are arranged to face each other along the front-rear direction, and the entire first facing surface 11A is covered by the second facing surface 11B.

As described above, in the connector of the present disclosure, the second housing 10B is separated from the first facing surface 11A of the first housing 10A if the second housing 10B is temporarily held. Thus, the deflection of the first locking lances 14A is allowed and the terminals can be mounted into the first housing 10A. Further, if the second locking lances 14B are exposed on the surface of the second housing 10B facing the first facing surface 11A, the terminals can be mounted also into the second housing 10B by temporarily holding the second housing 10B. Thereafter, the second housing 10B can reach a state where the second housing 10B can cover the first facing surface 11A of the first housing 10A (hereinafter, referred to as the fully locked state) by releasing the temporarily held state of the second housing 10B. A partial locking structure by the lock receiving portions 22 and the partial locking portions 43 is formed on the rear end sides of the first and second housings 10A, 10B, but is not formed on the front end sides of the first and second housings 10A, 10B. A supporting structure by the shaft portions 42 and the bearing portions 21 is formed on the front end sides of the first and second housings 10A, 10B. Until the second housing 10B reaches the fully locked state from the temporarily held state, the shaft portions 42 rotate with respect to the bearing portions 21, whereby a state supported in the bearing portions 21 is maintained. Therefore, it is possible to eliminate a concern that the front end side of the second housing 10B drops toward the first housing 10A to reach the fully locked state in temporarily holding the second housing 10B on the first housing 10A and to easily maintain the partially locked state.

In the connector of the present disclosure, the partial locking portions 43 and the lock receiving portions 22 are arranged to contact along the front-rear direction. In this way, the temporarily held state in which the second housing 10B is inclined can be satisfactorily maintained.

In the connector of the present disclosure, the lock receiving portion 22 includes the front stop portion 26 configured to contact the front end of the partial locking portion 43. In this way, the second housing 10B in the inclined state can be prevented from being displaced forward with respect to the first housing.

In the connector of the present disclosure, the first housing 10A includes the pair of side walls 20 rising from the first facing surface 11A, the second housing 10B includes the pair of side surfaces 41 facing the inner surfaces of the pair of side walls 20, the pair of side surfaces 41 include the shaft portions 42 having a convex shape, the pair of side walls 20 include, on the inner surfaces facing each other, the bearing portions 21 having a concave shape and the guiding surfaces 23 inclined away from each other from the side of the bearing portions 21 toward the tips of the side walls 20 in a rising direction. In this way, in the connector, the shaft portions 42 can be slid along the guiding surfaces 23 to deflect and deform the side walls 20 in the process of bringing the second housing 10B closer to the first facing surface 11A of the first housing 10A. The second housing 10B can be locked to the front end side of the first housing 10A by releasing the deflected state of the side walls 20 and fitting the shaft portions 42 into the bearing portions 21. In this way, the second housing 10B can be assembled from a position separated from the first facing surface 11A of the first housing 10A.

Other Embodiments

The present invention is not limited to the above described and illustrated embodiment and is represented by claims. The present invention is intended to include all changes in the meaning of equivalents to claims and in the scope of claims and include also the following embodiments.

The connector of the present disclosure may be assembled in an order other than an order of inserting the first terminal fittings into the first housing 10A, inserting the second terminal fittings into the second housing 10B or partially locking the second housing 10B to the first housing 10A and inserting the second terminal fittings into the second housing 10B. For example, the second terminal fittings may be inserted into the second housing 10B, the second housing 10B may be partially locked to the first housing 10A and the first terminal fittings may be inserted into the first housing 10A. The order can be changed as appropriate.

In the above embodiment, the shaft portions 42 and the bearing portions 21 are respectively formed into a convex shape and a concave shape. However, the shaft portions 42 and the bearing portions 21 may be respectively formed into a concave shape and a convex shape.

In the above embodiment, the inclined surface 45 is provided on the rear end side of the upper surface of the partial locking portion 43. However, the inclined surface 45 may be provided on the entire upper surface or the rear end side of the partial locking portion 43.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising: a first housing; and a second housing to be arranged to cover one surface of the first housing, wherein: the first housing includes a bearing portion provided on a front end side and a partial lock receiving portion provided behind the bearing portion, the second housing includes a shaft portion provided on a front end side and to be rotatably supported in the bearing portion and a partial locking portion provided behind the shaft portion, and the partial locking portion locks the partial lock receiving portion to temporarily hold the second housing such that a state inclined rearward from the shaft portion away from the one surface is maintained; wherein the partial locking portion includes an inclined surface that is inclined downward toward a rear side on a rear end side of an upper surface, and the inclined surface of the partial locking portion and a lower surface of the partial lock receiving portion are arranged to contact along a front-rear direction.

2. The connector of claim 1, wherein the partial locking portion and the partial lock receiving portion are arranged to contact along a front-rear direction.

3. The connector of claim 1, wherein the partial lock receiving portion includes a front stop portion configured to contact a front end of the partial locking portion.

4. The connector of claim 1, wherein:

the first housing includes a pair of side walls rising from the one surface side, the second housing includes a pair of side surfaces facing inner surfaces of the pair of side walls, the pair of side surfaces include the shaft portions having a convex shape, and the pair of side walls include, on the inner surface facing each other, the bearing portions having a concave shape and guiding surfaces inclined away from each other from the side of the bearing portions toward tips of the side walls in a rising direction.

5. The connector of claim 1, wherein each of the pair of side surfaces further includes a full locking portion provided above the partial locking portion, and the full locking portion locks the partial lock receiving portion to arrange the second housing in a state stacked on the first housing.

* * * * *